US006029275A

United States Patent [19]

De Prado

[11] Patent Number: 6,029,275

[45] Date of Patent: Feb. 29, 2000

[54] PROTECTIVE GLOVE FOR USE WITH NYLON STOCKINGS AND OTHER SNAG PRONE GARMENTS

[76] Inventor: Linda De Prado, 20918 Park Canyon Dr., Katy, Tex. 77450

[21] Appl. No.: 09/307,534

[22] Filed: May 7, 1999

[51] Int. Cl.[7] ..... A41D 19/00

[52] U.S. Cl. ..... 2/159; 2/161.6; 2/170

[58] Field of Search ..... 2/159, 16, 20, 2/125, 128, 161.6, 167, 170, 268, 910

[56] References Cited

U.S. PATENT DOCUMENTS

| | | | |
|---|---|---|---|
| 2,670,473 | 3/1954 | Stebic | 2/159 |
| 4,752,973 | 6/1988 | Wolfberg et al. | 2/163 |
| 5,020,159 | 6/1991 | Hellickson | 2/158 |
| 5,452,478 | 9/1995 | Rombach et al. | 2/161.6 |
| 5,711,032 | 1/1998 | Carpenter | 2/158 |

*Primary Examiner*—Diana Oleksa
*Assistant Examiner*—Katherine Moran
*Attorney, Agent, or Firm*—Gunn & Associates, P.C.

[57] ABSTRACT

A dressing glove is set forth. It is constructed for wearing while putting on garments likely to tear easily including sheer garments and stockings. Preferably, it incorporates fingertips which are knit with a high thread count cloth or which is polished and slick in the fashion of satin, thereby reducing the areas which might snag the sheer cloth, and also includes an elongate sleeve extending up the forearm of the user. In the sleeve, there is one or more eyelets which fully encircle the sleeve and which enclose elastic bands. In addition, the end of the sleeve terminates at a cuff which has a pucker string in it to enable it to be tied if desired.

10 Claims, 1 Drawing Sheet

FIG. 1
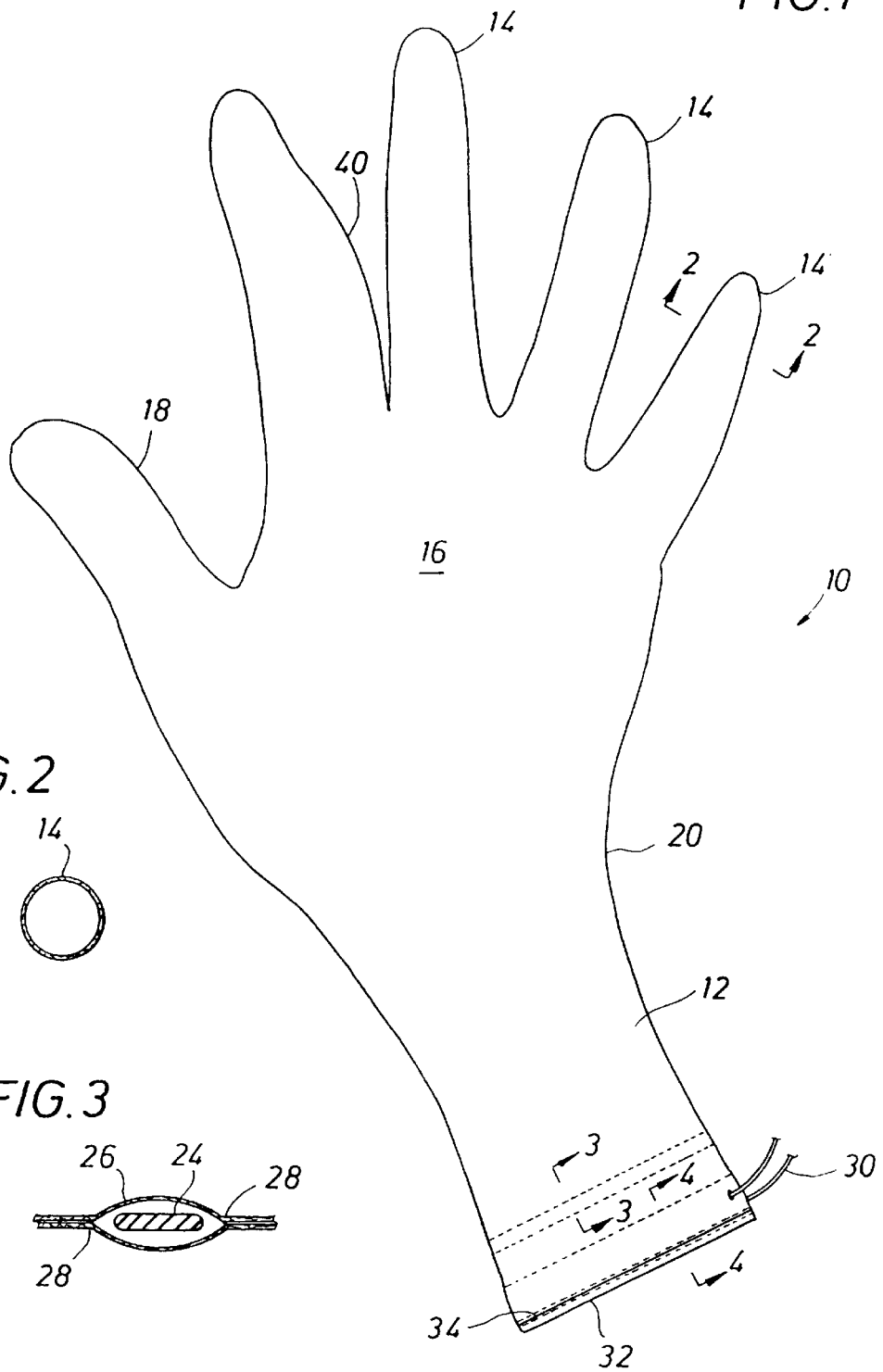
FIG. 2
FIG. 3
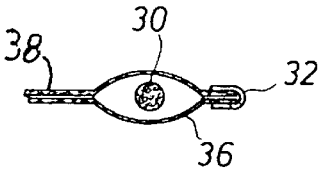
FIG. 4

PROTECTIVE GLOVE FOR USE WITH NYLON STOCKINGS AND OTHER SNAG PRONE GARMENTS

BACKGROUND OF THE DISCLOSURE

This is disclosure is directed to a glove, and in particular, to a glove which is constructed for use by women when putting on or taking off garments and clothing which are susceptible to snagging. A classic example of this involves a woman wearing rings or bracelet type jewelry attempting to smooth out typical thin or sheer stockings. Fingernails pose a problem. In addition to that, problems arise from the sharp points or corners on jewelry and especially rings and bracelets. It is less likely to be a problem with the cloth cuff of a long sleeve shirt or the seam of a jacket or coat. For smoothing purposes, it is possible to develop a careful style where the rings and jewelry are removed temporarily, and the fingernails are polished and buffed to remove sharp points in the corners. The mesh of sheer stocking material is very sensitive to snags. They will not only snag or tear, breaking one or more threads, but they will form a "run" which extends along the woof or warp of the cloth. More in the fashion of a knit, there is some flexure in the sheer stocking material, but it is quickly damaged as a result of this kind of snag or run. Not only does it create a problem, it becomes unsightly and is the kind of problem which cannot be easily, quickly, or readily repaired. Consequently, the entire garment can be damaged and is discarded when that occurs.

To avoid this problem, it is desirable that sharp edges be covered. This solution proposes a pair of gloves which are formed for easy handling of sheer knit garments. This covers stockings and other types of garments which are made of the same light or gauze type cloth. Moreover, this is a mechanism by which the user can protect the sheer garment. Such protection prevents what might be easily described as self inflicted damage to the cloth or other goods.

To consider the benefit, imagine for the moment that a person with average length fingernails and wearing customary and typical jewelry must put on a pair of socks, perhaps knee length socks, or perhaps full length stockings or other comparable cloth. When it is first touched by hand, there is always the risk of snagging or tearing. This disclosure sets out a mechanism by which snags and tears can be avoided. Moreover, the hand of the user is placed in the glove. The glove is worn to cover over the fingernails, but especially also the jewelry. It is a loose glove having sufficient room in it to fit over one or more rings on the fingers. This will cover rings mounted on the third finger, but also rings worn the other fingers. Likewise, it will cover a watch band or other bracelet which is around the wrist, also it will cover cuff links. By covering them, sharp corners are obscured so that they do not snag or tear.

Therefore and in light of this, the present disclosure sets forth a knit garment which has the form of a soft glove. The glove is constructed with seamless fingertips, i.e., they are formed by a knitting machine which shapes them to the desired shape. They are made of a high density thread count cloth. Whether knitted or woven, the cloth is shaped and formed into fingertips without seams. Preferably, the texture or surface irregularity are reduced to the point that it has a satin like finish. Considering cotton denim cloth at one extreme, the thread count is increased over 100 threads per inch, even about 150 threads per inch. As the number of threads in increased, thereby decreasing the surface roughness, the tendency to snag on the fingertips of the glove is reduced significantly and it becomes very protective. This is accomplished by forming the glove with at least the fingertips constructed in that fashion. By that, references made to a glove constructed with the five fingers in it and at least that region of the gloves is formed with such protection.

The present disclosure sets forth a glove which has a length for the hand sufficient to cover from the tip of the longest finger to the wrist, between the forearm and the hand. While that length provides coverage for the hand, the length of the glove of the present disclosure is preferably twice that measure. Accordingly, if the hand portion is seven inches in length, then the portion covering the forearm is preferably about equal in length. By making the long sleeve, this assures that the glove when worn reaches well up the arm and thereby stops snags and tears from jewelry on the arm. It prevents snags and tears so that no difficulty arises in the use of the glove of the present disclosure. The glove is highly protective of the user and the relatively easily snagged clothing typified by stockings and other light weight mesh cloth materials.

To consider this in better context, the problem more typically arises with women than men. To start the day, every woman must dress. If there is a press for time, the procedure becomes hasty and hurried. When rushed, the urgency of the moment causes difficulties, and the difficulties increase with the urgency. The accentuates hasty rushing. As a result, sharp corners on the jewelry or pointed fingernails will typically prompt such tearing. The gloves of the present disclosure, assumed to be provided as pair, can be quickly donned and enable the user to then smoothly, with less risk, put on sheer garments including stockings, quickly, readily and easily. The absence of the sharp corners and covered fingernails achieved by the gloves enhances speed. Then, the hurried circumstance is not so upsetting and so prone to snagging and tearing.

The present glove comprises a glove with five fingers deployed with a long sleeve which is positioned about and around the wrist and part of the forearm. The sleeve comprises approximately fifty percent of the length; the glove comprises the remaining fifty percent. The sleeve terminates at a pucker string which has two ends which are exposed and which can be tied together or wrapped around the upper end of the sleeve. Alternately, or in supplementation, the upper end of the sleeve also comprises an elastic stretch band which is positioned in a cloth loop, thereby enclosing it for easy use. It stretches and the retracts, thereby enabling the larger hand to be inserted through the sock, but it closes on the arm to provide a measure of engagement. This functions as a frictional grasp, thereby holding the upper end of the sleeve snug above the wrist, and thereby holding the jewelry, bracelets, and watches in a covered circumstance.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view of a glove in accordance with the present disclosure having an elongate sock adapted to extend up the arm of the user while covering the hand;

FIG. 2 is a sectional view taken along the line 2—2 of FIG. 1 illustrating the seamless knit construction of the end of the fingers so that snagging is reduced;

FIG. 3 is a sectional view through an elastic band which pulls the sock tight around the wrist of the user; and FIG. 4 is a similar sectional view through the end of the sock showing a string in the sock used conveniently for pulling the sock tight around the wrist.

DETAILED DESCRIPTION OF THE PREFERRED EMBODIMENT

Attention is now directed to FIG. 1 of the drawings which shows the glove 10 in accordance with the present disclosure. The glove 10 is constructed of a particular cloth material. In the preferred form, it is constructed so that it is completely around the hand and the extended part of the arm including the wrist above the hand and a potion of the forearm stretching up toward the elbow. Roughly, the glove is comprised of two portions, and about fifty percent of its length makes up the glove portion proper, that portion which fits around the hand above the wrist, and the sleeve portion 12 which is approximately equal in length to the glove portion thereabove. The sleeve portion provides some length extending up toward the elbow, and is sized to fit around the forearm. It does not need to reach the elbow, but rather is around the elbow up to that part so that the glove can enclose jewelry around the wrist and forearm. Examples will be given later. The cloth material of the glove is conveniently uniform over the entire glove. It is especially important to note that the tip regions 14 on all of the fingers are made with the same cloth construction. Seamless construction is achieved. It is believed to be well known that knitting machines can be adapted for fabrication of the fingertips so they are substantially seamless. This is exemplified as illustrated in FIG. 2 where the fingertip portion is shown. It is formed of cloth woven by a knitting machine so that the particular tip region has no protruding seams. To the extent that seams might otherwise be included, they pose a problem in that they are more likely to form rough areas which rough areas may snag. As thicker, heavier, or stiffer cloth is used, the seams become all the more bulky and tend to protrude. Protruding seams raise the risk of snagging. In general terms, it is therefore better over the long run that the fingertips 14 be constructed so that the nails are covered and the cloth is relatively smooth and has a smooth surface presentation. In fact, the surface should be smooth so that the seam is thereby avoided. Otherwise, any seam in that region tends to protrude and snag, especially when it is at the end of one of the fingernails.

The cloth preferably has a high thread count. With a high thread count, and especially with a tight weave, the relatively high thread count defines a smoother surface which is less likely to snag. The smooth surface is shaped for smooth touching of the sheer clothing. A thread count of perhaps 100 threads per inch or greater is not uncommon. That is more desirable, especially with woven cloths formed of threads having a finish which is somewhat "slicker" such as silk or satin finishes. To be sure, for durability, cotton is acceptable provided the cloth is a relatively tight weave, featuring a high thread count. By contrast, heavy denims which have perhaps half the thread count, are less desirable, and can only become useful when over time they are worn and buffed to define a softer and smoother outer surface. However, since that might be delayed over a time interval, it is far better to use a relatively high thread count cloth, typically 100 threads or greater per inch.

Going back to FIG. 1 of the drawings, it will be observed that the glove 10 is formed with the requisite fingers and thumb to enable grasping, and the glove is constructed with the fingers connected to the back of the glove 16. There is a protruding thumb 18 in the customary location. The glove tapers to a smaller dimension at the wrist area 20. The sleeve then extends therebeyond. The sleeve portion terminates as mentioned. To provide some perspective on this, the glove typically has a length of somewhere between six and eight inches above the wrist, sufficient to accommodate a woman's hand, and has that much length below the wrist which makes up the sleeve. At some location, perhaps at even two or three locations, it is constructed with an elastic band to pull snug. The common band construction is illustrated in FIG. 3 of the drawings where the numeral 24 identifies an elastic band. It is sewed in a slightly larger cloth passage 26 which is formed of two pieces of cloth which are seamed together at 28. The two layers of cloth are stitched to define the eyelet 26 which fully encircles the sleeve so that the elastic band 24 can pull snug against the forearm.

As an option or in supplementation, the far or open end of the sleeve is provided with a pucker string. Briefly, the end of the sleeve is constructed with a seam just adjacent to the string 30. The string 30 is parallel to the end seam 32, and that in turn is parallel to an adjacent row of stitching at 34. The two parallel stitching rows making up the seam and stitching at 34 defines an open eyelet better shown in FIG. 4 of the drawings. The string 30 is shown there. FIG. 4 shows the string 30. It is threaded through an eyelet 36. The reinforced edge 32 has the form of a seam and is sewed or stitched several times over. To avoid fraying of the edges of cloth, a cuff is folded over the edges to reinforce and stiffen the lower end of the sleeve. The sleeve is formed of two layers of cloth at 38 as illustrated in FIG. 4 of the drawings. In FIG. 1 of the drawings, the index finger is larger at 40. The diameter of the finger is increased to accommodate a ring on the index finger. Alternately, the enlargement can be located on any of the other fingers, or all of the fingers for that matter. As desired, it is helpful to do this so that the glove can be adapted for use without requiring one or more rings to be removed. For purposes of style, some women prefer to wear few rings while others will wear four or five rings on the fingers of one hand. It is least common to wear rings around the thumb and little finger; accordingly, the bulge 40 is commonly located on the third finger, which is often called the ring finger, and optionally can be on the other two fingers which are commonly denoted at the index finger and the large finger. Suffice it to say, this is a matter of choice and can be accommodated simply by making the glove finger larger towards the base.

As will be understood, the glove of the present disclosure is made in symmetrical mirror image versions for wearing on both hands. Commonly, the glove of the present disclosure is used with its mate so that the pair of gloves together provide the benefits which are intended in the present disclosure.

While the forgoing is directed to the preferred embodiment, the scope is determined by the claims which follow:

I claim:

1. A hand glove to protect sheer garments from snags while putting the garments on or off, wherein the glove comprises:

(a) seamless fingertip portions fabricated from woven fabric and having a snag free characteristic so that the fingertip portions can engage said sheer garments;

(b) a back portion adjoining said finger tip portions; and (c) an elongate sleeve adjoining said back portion and reaching up a forearm of a user so that jewelry on the wrist or fingers of the user is covered by the glove to prevent snagging of said garments by the jewelry.

2. The apparatus of claim 1 wherein the fingertip portions comprise the five fingers on the glove and are formed of a seamless knit cloth having a high thread count to reduce the tendency of the cloth to snag.

3. The apparatus of claim 2 wherein said elongate sleeve includes an encircling eyelet which defines an internal passage and an elastic band is placed in said passage so that the sleeve is pulled snug around the forearm of the user.

4. The apparatus of claim 2 wherein said sleeve includes a cuff at an end remote from said back portion of said glove and said end is closed at said cuff by a pucker string.

5. The glove of claim 1 wherein said fingertip portions including an opposed thumb with four fingers in the glove and wherein the thumb and fingers are all constructed of a snag free cloth.

6. The glove of claim 5 wherein said finger tip portions and said back and said sleeve are fabricated unitarily of said snag free cloth.

7. The apparatus of claim 6 wherein said glove is constructed with at least separate fingers for the fingers of the hand of the user and the fingers of the glove include one enlarged finger to accommodate rings on the finger of the hand of the user.

8. The apparatus of claim 7 wherein the fingertip portions of the glove are formed of said snag free cloth with a satin finish.

9. The apparatus of claim 8 wherein the fingertip and back portions comprises about one half the length of said glove and the sleeve portion comprises the remaining one half of the length thereof.

10. The apparatus of claim 9 wherein said elongate sleeve includes an encircling eyelet which defines an internal passage and an elastic band is placed in said passage so that the sleeve is pulled snug around the forearm of the user.

* * * * *